United States Patent [19]

Long

[11] Patent Number: 5,048,734

[45] Date of Patent: Sep. 17, 1991

[54] INSULATED CONTAINER JACKET

[76] Inventor: Granvill F. Long, P.O. Box 92, Ratten, Okla. 74562

[21] Appl. No.: 461,420

[22] Filed: Jan. 5, 1990

[51] Int. Cl.[5] ..... B65D 23/08; A45F 5/02

[52] U.S. Cl. ..... 224/148; 62/457.1; 150/901; 220/903; 220/DIG. 9; 224/228; 224/236; 224/251; 224/253; 224/901

[58] Field of Search ..... 224/148, 224, 228, 235, 224/236, 240, 241, 251, 252, 253, 901; 150/901; 220/903, DIG. 9; 62/457.1, 457.2, 457.4

[56] References Cited

U.S. PATENT DOCUMENTS

| | | | |
|---|---|---|---|
| D. 273,247 | 4/1984 | Pigott | D2/400 |
| D. 291,389 | 8/1987 | Crymes | 224/236 X |
| 1,594,358 | 8/1926 | Dunn, Jr. et al. | 150/901 X |
| 1,639,418 | 8/1927 | Washburn | 150/901 X |
| 1,949,677 | 3/1934 | Crawford | 220/903 X |
| 3,023,922 | 3/1962 | Arrington et al. | 220/903 X |
| 3,813,017 | 5/1974 | Pimsleur | 224/901 X |
| 4,018,371 | 4/1977 | George . | |
| 4,401,245 | 8/1983 | Zills | 224/148 |
| 4,802,602 | 2/1989 | Evans et al. | 224/148 X |
| 4,867,358 | 9/1989 | Bennis | 224/148 |
| 4,921,153 | 5/1990 | Smith | 224/253 |

*Primary Examiner*—Ernest G. Cusick

*Attorney, Agent, or Firm*—Laney, Dougherty, Hessin & Beavers

[57] ABSTRACT

An insulated container jacket which includes an open topped cylindrical body dimensioned to extend around a beverage container, or the like, and having an insulating material confined within fabric inner and outer layers. Secured to one side of the cylindrical body adjacent its open top is a first retaining element for detachably engaging a cover flap to retain a cover in a closure position across the open top of the cylinder. A second retaining element is connected to the lower side of the cylindrical body and is used to engage an elongated belt loop. A cover flap is hingedly connected to the cylindrical body at the open top thereof, and can pivot to a position of closure. It carries a retaining tab which engages the first retaining element. The cover flap also carries a thermal insulating pad which fits snugly within the open upper end of the cylindrical body.

9 Claims, 2 Drawing Sheets

284842 0428 --02 09-17-91 45579

INSULATED CONTAINER JACKET

FIELD OF THE INVENTION

This invention relates to a small, shape-conforming insulated jacket for holding beverage container or the like, and for thermally insulating a beverage container stored in the jacket.

BACKGROUND OF THE INVENTION

1. Brief Description of the Prior Art

In U.S. Pat. No. 4,018,371, a beverage belt is disclosed which is adapted to be worn by a person, with the belt including a housing formed of an insulating material. The housing defines a plurality of spaced beverage-containing compartments, each adapted to be closed by an insulative lid. Each of the beverage-containing compartments is generally cylindrical in configuration. The belt of this structure is not removable from the insulative material or the beverage compartments, but is secured in a fixed fashion to the insulating material.

U.S. Pat. No. DES.-273,247 depicts an insulated cylindrical holder for a beverage can, with a clasp or clip secured to one side of the insulated cylindrical holder to permit the holder to be clipped to the belt. A lid is hingedly connected to the base or bottom part of the cylindrical holder and can be pivoted between an open and a closed position.

In U.S. Pat. No. 4,401,245, a collapsible, insulated beverage container is illustrated and described. The beverage container comprises an insulated jacket for receiving a cylindrical container and a longitudinal gripping strap which is secured to one side of the jacket and extends along the entire height of the outer surface of the jacket. This facilitates gripping by the user of both the insulated jacket and the container held therein. The jacket utilized in this device is formed of inner and outer water resistant fabric layers within which is disposed insulative material. The whole is quilted together. The jacket preferably has a cylindrical configuration.

BRIEF DESCRIPTION OF THE PRESENT INVENTION

The present invention is an insulated container jacket, which, because of its construction, is relatively strong and is characterized in having a relatively long and trouble free service life without deterioration or breakage. The jacket also functions very efficiently for the retention of the temperature of a beverage or comestible in a container which is stored within the insulated container jacket.

Broadly described, the insulated container jacket includes a cylindrical body made of a quilted fabric which includes an insulating material core. The body has a bottom and an open top. A belt strap is secured to one side of the cylindrical body, and can be easily opened and closed by means of Velcro TM -type retaining or engaging tabs. Extended across the open top of the container is a closure which includes a frustoconical pad which fits closely within the open top of the container, and is sized to contact the top of a cylindrical can or other beverage container held within the jacket.

An important object of the invention is to provide an insulated container jacket which efficiently retains the temperature of a substance held within a container enclosed in the jacket.

A further object of the invention is to provide an insulated container jacket which can be quickly mounted on, and carried by, the belt of a person, and used to transport a beverage container or the like in this fashion.

A further object of the invention is to provide an insulated container jacket which could be used for containing a can, a jar or other liquid or comestible container, so as to insulate the contents thereof, and which insulated container jacket includes a quick detachable belt loop which can be passed through a belt or other retaining structure quickly and easily, and then manually secured in its retaining position.

Other objects and advantages will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
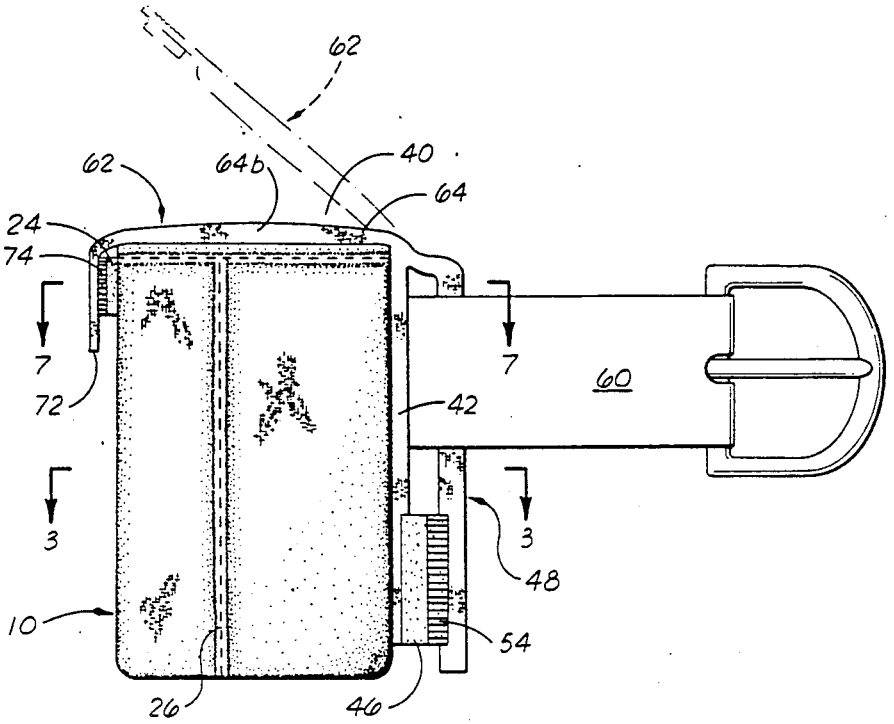
FIG. 1 is a side elevation view of the insulated container jacket of the invention. A cover flap used to close the open top of the cylindrical body of the jacket is shown in its opened position in dashed lines.

The insulated container jacket of the invention includes a generally cylindrical body which is designated generally by reference numeral 10. A cylindrical can 11 typically containing a beverage is illustrated in dashed lines. The cylindrical body 10 includes an insulated bottom panel 12 and a circular opening 14 at the top of the body. The cylindrical body 10 is constructed of a flexible fabric which includes an insulating material 16, such as foam rubber or styrofoam, located at the core thereof, and faced with an inner fabric panel or layer 18 and an outer fabric panel or layer 20. In a preferred embodiment of the invention, the flexible material of which the cylindrical body is constructed is a quilted material having the internal insulating material 16, such as foam rubber or the like, constituting the batting retained by quilting stitches 26 between the inner layer 18 and the outer facing layer or panel 20. Adjacent the open upper end 14 of the cylindrical body 10, the flexible fabric is shaped and sewn so as to provide a tapering internal surface adjacent the open upper end which forms a generally frustoconical sealing surface 22 at this location.

Stitched to one side of the cylindrical body at a location adjacent the open upper end thereof is a first retaining element or tab 24. The first retaining element 24 can be a Velcro TM tab carrying hooks or eyelets adapted to cooperate with an interengaging Velcro TM tab carried on a cover flap as hereinafter described.

In order to permit the insulated container jacket to be carried easily and safely on the belt of a hiker, sports fan or the like, a generally T-shaped carriage and closure subassembly, designated generally by reference numeral 40, is provided. The T-shaped carriage and closure subassembly 40 includes an elongated, generally vertically projecting leg 42 which is secured to the outer side of the cylindrical body 10 on the opposite side of the body from the side upon which the first retaining element 24 is located. The leg 42 includes the outer layer or panel 42*a*, an inner panel 42*b* and an intermediate insulating material 44. Secured to the outer panel 42*a* at the lower end of the downwardly extending leg 42, and facing outwardly away from the cylindrical body 10, is a second retaining element or tab 46. As in the case of the first retaining element or tab 24, the second retaining tab 46 may have exposed hooks or eyes (of the type used in Velcro TM construction) facing outwardly for engagement with a mating retaining tab or flap carried on a belt loop element as hereinafter described.

At its upper end, the elongated, downwardly extending leg 42 branches out or becomes bifurcated to form a belt loop, designated generally by reference numeral 48. The belt loop 48 is an elongated flexible fabric member, and, in fact, is preferably constructed of a quilted fabric as hereinbefore described. Thus, the outer panel or layer 42*a* of the leg 42 is continued and extended so as to form the inner panel or layer 48*b* of the belt loop 48, which also includes an outer panel or layer 48*a*. Insulating material 50 is placed in the center or core of the belt loop 48, and is in continuous communication with the insulating material 44 centrally located in the downwardly extending leg 42.

Figure 2:
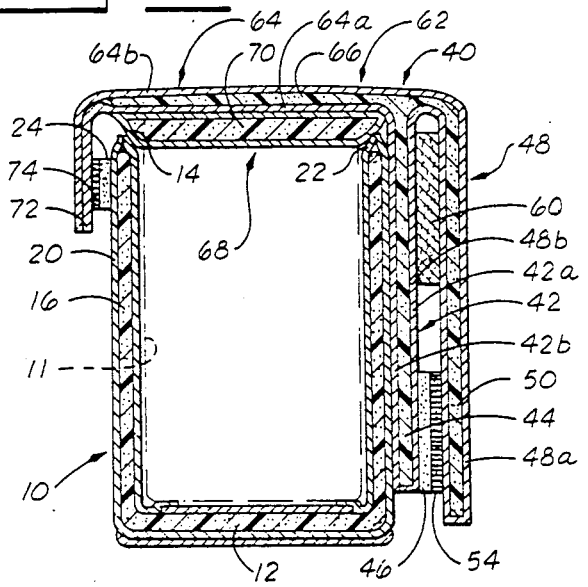
FIG. 2 is a sectional view taken along line 2—2 of FIG. 1.
Figure 3:
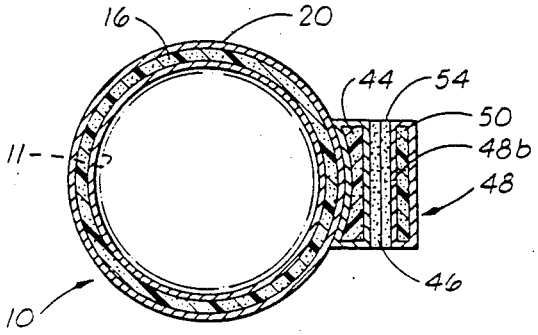
FIG. 3 is a sectional view taken along line 3—3 of FIG. 1.
Figure 5:
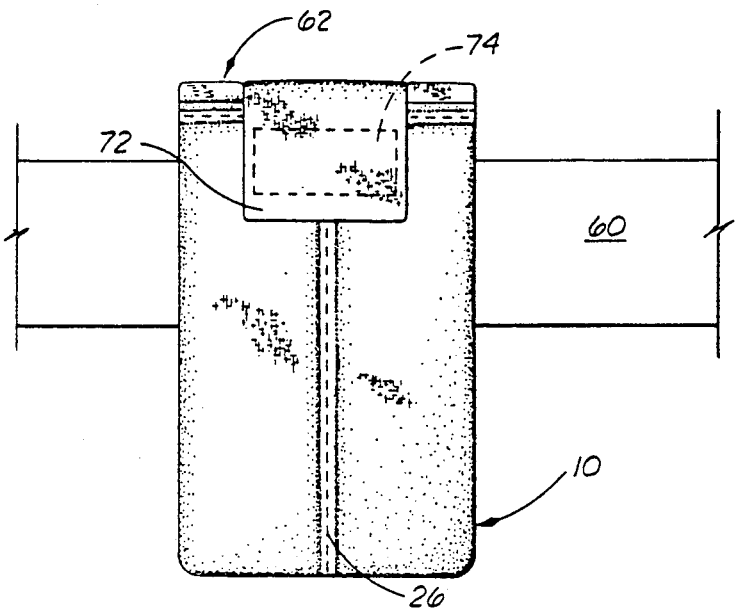
FIG. 5 is a front elevation view of the insulated container jacket of the invention.
Figure 6:
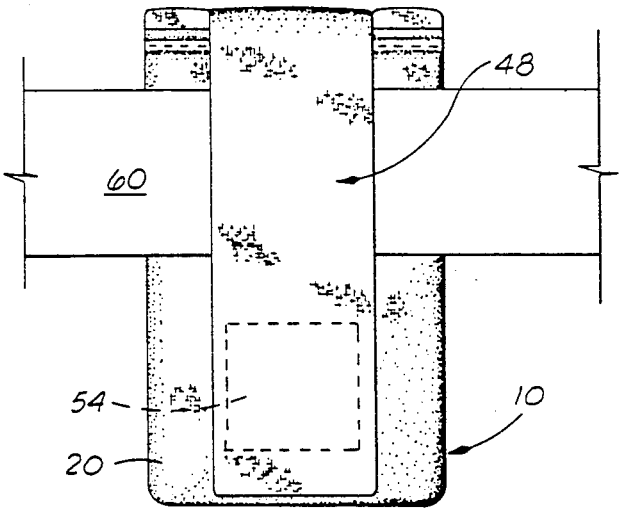
FIG. 6 is a rear elevation view of the insulated container jacket.
Figure 7:
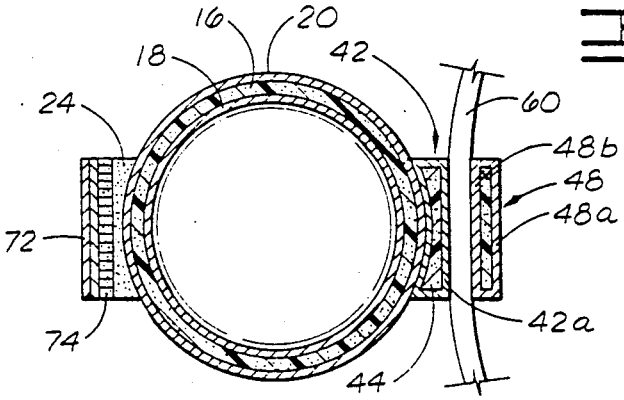
FIG. 7 is a sectional view taken along line 7—7 of FIG. 1.

At its lower end and on the inwardly facing side, the belt loop 48 carries an engaging or securing flap 54 which has cooperating hook or eye elements of the character used in Velcro TM contact fastening materials. The flap or tab 54 is thus readily engageable with the second retaining element 46 upon contact therewith, and when this engagement is effected, the insulated container jacket can then be used for supporting or carrying a beverage container or the like on the belt 60 in the manner shown in FIG. 1, and generally in cross-section in FIG. 2. There a belt is shown and denominated by reference numeral 60. The can of beverage carried within the jacket is denominated by dashed line reference numeral 11 as hereinbefore stated.

Figure 4:
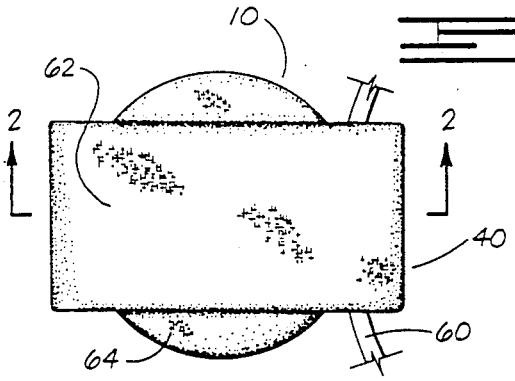
FIG. 4 is a plan view of the insulated container jacket.

In order to close the open upper end of the cylindrical body 10, a flexible cover panel designate<generally by reference numeral 62 is provided. The flexible cover panel 62 is formed integrally with the downwardly extending leg 42 and the belt loop 48, and is one of the bifurcation legs of the T-shaped carriage and closure subassembly 40. This cover panel leg of this subassembly 40 includes an upper or outer closure pad, designated generally by reference numeral 64. The outer closure pad 64 is constructed in the quilted fashion previously described so that it has an inner fabric panel or layer 64*a* and an outer fabric panel or layer 64*b*, with insulating material 66 positioned centrally therebetween. The insulating material 66 is preferably in communication with, and, in fact, a continuation of, the insulating material 44 and also the insulating material 50 used internally in the remaining parts of the carriage and enclosure subassembly 40. It will be noted in referring to FIG. 4 that the outer closure pad 64 of the flexible cover panel 62 is generally circular in configuration and is dimensioned to extend across and cover completely the open upper end of the cylindrical body 10.

In addition to the outer closure pad 64, the flexible cover panel 62 further includes a generally frustoconically-shaped inner closure pad 68 which is configured to fit snugly within the open upper end of the cylindrical body 10, so that it sealingly engages the tapering internal seat surface 22 which is of generally frustoconical configuration. The thickness of the inner closure pad 68 is such that it contacts the upper surface of the beverage container 11 carried within the jacket, and by such close engagement with the container affords efficient insulation of the container and maintenance of the temperature of the beverage carried therein. It will be noted that the closure pad 68 is constructed of insulating material 70 placed between inner and outer fabric panels in the manner of construction of other parts of the insulated container jacket hereinbefore described.

At its outer periphery, the generally circular outer closure pad 64 carries an interengaging tab or flap 72 which is flexible, and is constructed by bringing together and seaming in a contiguous relationship, the inner fabric panel 64*a* and outer fabric panel 64*b* of the outer closure pad 64. The interengaging tab or flap 72 carries a Velcro TM tab 74 or the like on the inner side thereof at a location positioned for engagement with the first retaining element 24 carried near the upper end of the cylindrical body and on the outer side of the body.

The generally T-shaped configuration and construction of the carriage and closure subassembly 40 is an important feature of the present invention since it provides enhanced mechanical strength for both the belt loop 48, and for the flexible cover panel 62. Thus, even though there may be a force or blow inadvertently brought to bear upon the top of the insulated container jacket when there is a beverage container contained therein and projecting outwardly from a belt 60 which is extended through the belt loop 48, the belt loop will not be detached, or broken away, from the cylindrical body 10 because it has not only the strength of the downwardly extending leg 42 to retain it attached to the cylindrical body, but the flexible cover panel 62 and interengaging tab 72 also function to resist detachment.

Although a preferred embodiment of the invention has been herein described, it will be understood that various changes can be made in the described and illustrated structure without departure from the basic principles which underlie the invention. Changes and innovations of this type are therefor deemed to be circumscribed by the spirit and scope of the invention, except as the same may be necessarily limited by the appended claims, or reasonable equivalents thereof.

What is claimed is:

1. An insulating container jacket comprising:

a cylindrical body of flexible, insulation lined fabric having a bottom panel and having an open top at the other end of the cylindrical body from the panel; and a T-shaped carriage and closure subassembly attached to the cylindrical body and facilitating carriage and closure of the cylindrical body when a beverage container is carried therein, said T-shaped carriage and closure subassembly comprising:

an elongated, downwardly extending leg secured to one side of said cylindrical body, and having an upper end and a lower end, and extending parallel to the axis of the cylindrical body;

a flexible, elongated belt loop element having one end secured to, and formed integrally with, the upper end of said downwardly extending leg, and having a second end extendable through a belt and connectable to the lower portion of the cylindrical body; and cover panel means having an outer periphery and a point hingedly connected at one location on its outer periphery at said point of hinged connection to the upper end of said downwardly extending leg and to said belt loop element and comprising:

an outer closure pad having an outer periphery and extending across and covering the open top of the cylindrical body;

an inner closure pad fitting closely within said open top of the cylindrical body; and an engaging tab on the outer periphery of said outer closure pad on the opposite side of said cover panel means from its point of said hinged connection to said downwardly extending leg.

2. An insulating container jacket as defined in claim 1 and further characterized as including a retaining element on said cylindrical body at a location to engage said engaging tab on said outer closure pad when said outer closure pad is closed and open top of the cylindrical body.

3. An insulating container jacket as defined in claim 1 wherein said cylindrical body includes a cylindrical side wall which comprises:

an inner fabric cylindrical liner;

an outer fabric cylindrical liner; and an insulating material retained between said inner and outer cylindrical liners.

4. An insulating container jacket as defined in claim 3 wherein said cylindrical body includes:

a cylindrical side having a radially outwardly tapering portion of said inner fabric cylindrical liner and of said insulating material adjacent, and surrounding, said open top of said cylindrical body and forming an annular, frustoconically-shaped seat therearound; and wherein said inner closure pad is further characterized as having an annular frustoconical seating surface therearound for sealingly engaging said seat when said inner closure pad is closed.

5. An insulating container jacket as defined in claim 4 wherein said inner closure pad includes:

an inner fabric layer;

an outer fabric layer; and insulation between said inner and outer fabric layers.

6. An insulating container jacket as defined in claim 5 and further characterized as including a retaining element on said cylindrical body at a location to engage said engaging tab on said outer closure pad when said outer closure pad is closed and covers the open top of the cylindrical body.

7. An insulating container jacket as defined in claim 6 and further characterized as including:

a retaining tab on said cylindrical body adjacent the lower end of said cylindrical side wall and adjacent said bottom closure panel; and an engaging flap secured to said second end of said belt loop element for contacting and engaging said retaining tab.

8. An insulating container jacket as defined in claim 1 and further characterized as including:

a retaining tab on said cylindrical body adjacent the lower end of said cylindrical side wall and adjacent said bottom closure panel; and an engaging flap secured to said second end of said belt loop element for contacting and engaging said retaining tab.

9. An insulating container jacket as defined in claim 8 and further characterized as including a retaining element on said cylindrical body at a location to engage said engaging tab on said outer closure pad when said outer closure pad is closed and covers the open top of the cylindrical body.

* * * * *

UNITED STATES PATENT AND TRADEMARK OFFICE

CERTIFICATE OF CORRECTION

PATENT NO. : 5,048,734

DATED : September 17, 1991

INVENTOR(S) : Granvill F. Long

It is certified that error appears in the above-identified patent and that said Letters Patent is hereby corrected as shown below:

Column 1, line 6, add a "s" to the word "container".

Column 3, line 50, add a "d" to the word "designate" and delete " < " in that sentence.

Column 5, line 25, after the word "and" insert -covers the-.

Signed and Sealed this

Nineteenth Day of January, 1993

*Attest:*

DOUGLAS B. COMER

*Attesting Officer*

*Acting Commissioner of Patents and Trademarks*